United States Patent [19]

Takenaka et al.

[11] Patent Number: 4,712,043

[45] Date of Patent: Dec. 8, 1987

[54] ELECTRON GUN WITH LARGE APERTURE AUXILIARY ELECTRODE

[75] Inventors: Shigeo Takenaka; Eiji Kamohara, both of Fukaya, Japan

[73] Assignee: Kabushiki Kaisha Toshiba, Kawasaki, Japan

[21] Appl. No.: 702,725

[22] Filed: Feb. 19, 1985

[30] Foreign Application Priority Data

| | | | |
|---|---|---|---|
| Feb. 20, 1984 | [JP] | Japan | 59-28611 |
| Feb. 20, 1984 | [JP] | Japan | 59-28612 |
| Mar. 29, 1984 | [JP] | Japan | 59-59441 |

[51] Int. Cl.[4] ..... H01J 29/46; H01J 29/56

[52] U.S. Cl. ..... 315/15; 313/414; 313/449

[58] Field of Search ..... 315/14, 15, 16, 382; 313/414, 449

[56] References Cited

U.S. PATENT DOCUMENTS

| | | | |
|---|---|---|---|
| 3,678,329 | 7/1972 | Miyaoka | 315/14 |
| 3,895,253 | 7/1975 | Schwartz et al. . | |
| 3,932,786 | 1/1976 | Campbell . | |
| 3,995,194 | 11/1976 | Blacker, Jr. et al. . | |
| 4,124,810 | 11/1978 | Bortfeld et al. | 313/414 |
| 4,168,452 | 9/1979 | Christensen et al. | 315/16 |
| 4,317,065 | 2/1982 | Hughes . | |
| 4,366,415 | 12/1982 | Takenaka et al. . | |
| 4,368,405 | 1/1983 | Takenaka et al. | 315/16 |
| 4,374,341 | 2/1983 | Say . | |
| 4,429,252 | 1/1984 | Vieland . | |
| 4,514,661 | 4/1985 | Stone | 315/16 |

FOREIGN PATENT DOCUMENTS

| | | |
|---|---|---|
| 530484 | 7/1953 | Belgium . |
| 2394169 | 1/1979 | France . |

OTHER PUBLICATIONS

Patent Abstracts of Japan, vol. 4, No. 28 (E1) (510), 8th Mar. 1980, p. 120E1; & JP-A 55 3105 (Hitachi Seisakusho K.K.), 10-01-1980.

Patent Abstracts of Japan, vol. 7, No. 239 (E-206) (1384), 25th Oct. 1983; JP-A-58-128 637 (Nippon Denki K.K.), 01-08-1983.

*Primary Examiner*—Theodore M. Blum

*Attorney, Agent, or Firm*—Cushman, Darby & Cushman

[57] ABSTRACT

An electron gun for producing and directing at least one electron beam along a beam path comprises a beam forming section and a main lens section for focusing the electron beam. The main lens section includes first and second electrodes arranged along the beam path and having an aperture through which the electron beam is passed, and at least one auxiliary electrode which is located between the first and second electrodes, the auxiliary electrode having an aperture through which the electron beam is passed. The aperture of the auxiliary electrode is greater than each of the apertures of the first and second electrodes. Different voltages are applied to the first and second electrodes, and the auxiliary electrode is supplied with a middle voltage intermediate between the two voltages applied to the first and second electrodes.

11 Claims, 30 Drawing Figures

ELECTRON GUN WITH LARGE APERTURE AUXILIARY ELECTRODE

BACKGROUND OF THE INVENTION

The present invention relates to an electron gun for a cathode-ray tube, and more specifically to an electron lens of an electron gun for focusing at least one electron beam, preferably two or more electron beams.

Conventionally, a cathode-ray tube includes at least one electron gun. The electron gun comprises a beam forming section for producing an electron beam and a main lens section for focusing the electron beam on the target. The spot diameter of the electron beam on the target is a very important factor to determine the performance of the cathode-ray tube. The spot diameter on the target should preferably be minimized, depending on the performance of the electron gun. Improvement of the performance of the main lens section is an effective measure for improving the performance of the electron gun.

The main lens section is chiefly composed of an electrostatic electron lens. In the electron lens region, a plurality of electrodes each having an aperture are coaxially arranged so as to be applied with predetermined voltages. There may be several, types of such electrostatic electron lenses which vary according to the variety of voltages. For higher performance of the main lens section, however, it is necessary to increase the size of the aperture, thereby increasing the lens aperture in the optical sense, or to lengthen the separation distance of the electrodes to cause a gradual potential change in the region around the electrodes, thereby forming a long-focus lens having a long focal length.

The prior art electron gun for a cathode-ray tube is sealed in a cylindrical glass tube, i.e., the neck portion of a cathode-ray tube. Therefore, the size of aperture of the electrodes or the lens diameter is practically restricted by the diameter of the cylindrical glass tube. Also, the separation distance of the electrodes is limited so that an electrostatic focusing field formed between the electrodes may not be influenced by any other undesired electric fields in the cylindrical glass tube. In a color picture tube, in particular, if a plurality of electron guns are arranged in line, narrower intervals between the electron guns will make it easier to converge a plurality of electron beams on the same point on the whole surface of a screen. In consideration of deflection, moreover, the narrow intervals between the electron guns improve the economy of electric power. The narrower intervals, however, require further reduction in size of the apertures of the electrodes.

In the cathode-ray tube as described above, the lens performance is expected to be improved by the use of a long-focus lens which can produce, without extension of the separation distance of the electrodes, an effect equivalent to that obtained with use of a longer separation distance. There are proposed several electrostatic electron lenses for such a cathode-ray tube, including a "distributed Einzel lens" disclosed in U.S. Pat. No. 3,895,253 by Schwartz et al., a "tripotential lens" disclosed in U.S. Pat. No. 3,995,194 by Blacker et al., a "multi-element bipotential lens" disclosed in U.S. Pat. No. 3,932,786 by Campbell, and a "single-element bipotential lens" disclosed in U.S. Pat. No. 4,124,810 by Bortfeld et al. Among these lenses, the distributed Einzel lens disclosed in U.S. Pat. No. 3,895,253 is not practical because, in this lens, electric discharge is liable to be caused between the relatively low voltage of the beam forming section and the higher anode voltage at the main lens section nearest thereto.

In the tripotential lens disclosed in U.S. Pat. No. 3,995,194 and the single-element bipotential lens disclosed in U.S. Pat. No. 4,124,810, three cylindrical electrodes with the same diameter are arranged along electron beams for low, middle, and high voltages, so that a gradual potential change is produced at the main lens section. An optimum lens performance may be obtained if the length of the middle-voltage electrode is substantially equal to the radius of the electrode aperture. However, the lens performance cannot further be improved.

For additional improvemnt of the lens performance, therefore, the multi-element bipotential lens disclosed in U.S. Pat. No. 3,932,786 is proposed. In an electron gun using this lens, however, resistors arranged near the individual electrodes are small. Thus, the electron gun of this type is unfit for practical use. Moreover, since the voltages of the electrodes are picked up at narrower intervals from the small resistor, the construction and manufacture of the electron gun are complicated. The small gaps between the electrodes facilitate the flow of leakage current between the electrodes. Consequently, undesired current is produced by the leakage current, beam impact hit on the electrodes, and other factors, resulting in a change of electrode potential and lowering the lens performance. These drawbacks make it very hard to put the electron gun of this type to practical use.

To increase the diameter of the electron lens, moreover, electron guns of the following types are conventionally proposed. In an electron gun for a color picture tube disclosed in Japanese Patent Application Disclosure No. 124933/80, three electron lenses are formed overlapping one another. In another electron gun stated in "Proceedings of the Third Interational Display Research Conference, Japan Display, 1983, pp. 268 through 271, apertures of electrodes are conical. In an electron gun disclosed in Japanese Patent Application Disclosure No. 103246/82, moreover, projections are formed around three apertures. In these electron guns, the diameter of each electron lens is increased so that the lens performance is improved in some measure. For further improved lens performance, the separation distance of the electrodes need to be increased. This separation distance cannot, however, be increased, since it is influenced by undesired electrostatic fields in the neck.

SUMMARY OF THE INVENTION

The object of the present invention is to provide an electron gun for a cathode-ray tube with improved performance of an electron, lens, especially of a main lens section, which is simple in construction and easy to manufacture.

According to the present invention, an electron gun is provided for producing and directing at least one electron beam along a beam path, which comprises a beam forming element and a main lens for focusing the electron beam. The main lens includes first and second electrodes arranged along the beam path, having an aperture through which the electron beam is passed, and at least one auxiliary electrode which is located between the first and second electrodes. The auxiliary electrode includes at least one electrode having an aperture through which the electron beam is passed, the aperture of the auxiliary electrode being greater than each of the apertures of the first and second electrodes. The electron gun further comprises voltage applying means for respectively applying first, second and auxiliary voltages to the first, second and auxiliary electrodes, the first and second voltages being of different levels. An electrostatic field is thus formed between the first and second electrodes. The auxiliary voltage is higher than the lower one of the first and second voltages and is lower than the higher one.

In the electron gun with the construction described above, a long-focus lens equivalent to one which may be obtained by increasing the distance between the first and second electrodes is formed between the first and second electrodes.

DETAILED DESCRIPTION OF THE PREFERRED EMBODIMENTS

Figure 1:
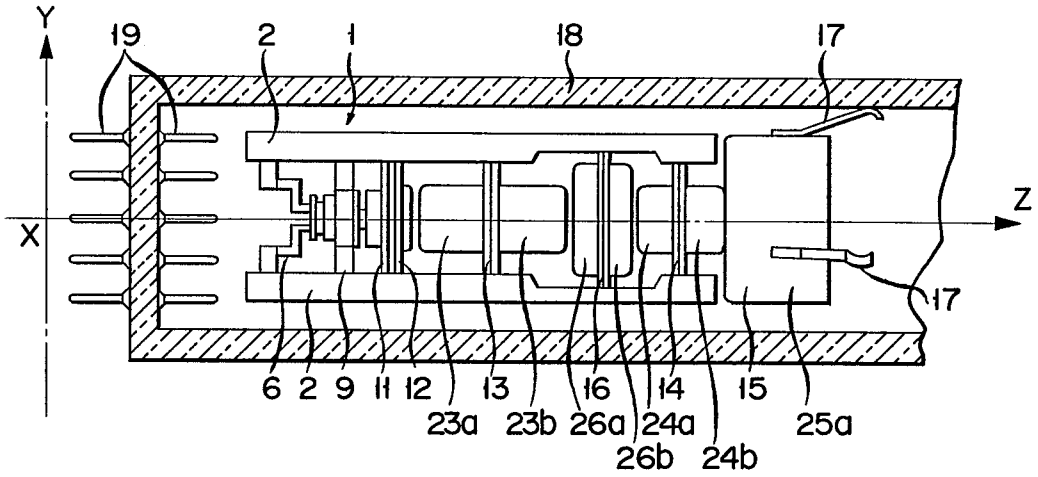
FIG. 1 is a schematic side view of an electron gun according to one embodiment of the present invention applied to a color picture tube, showing the electron gun along its tube axis.
Figure 2:
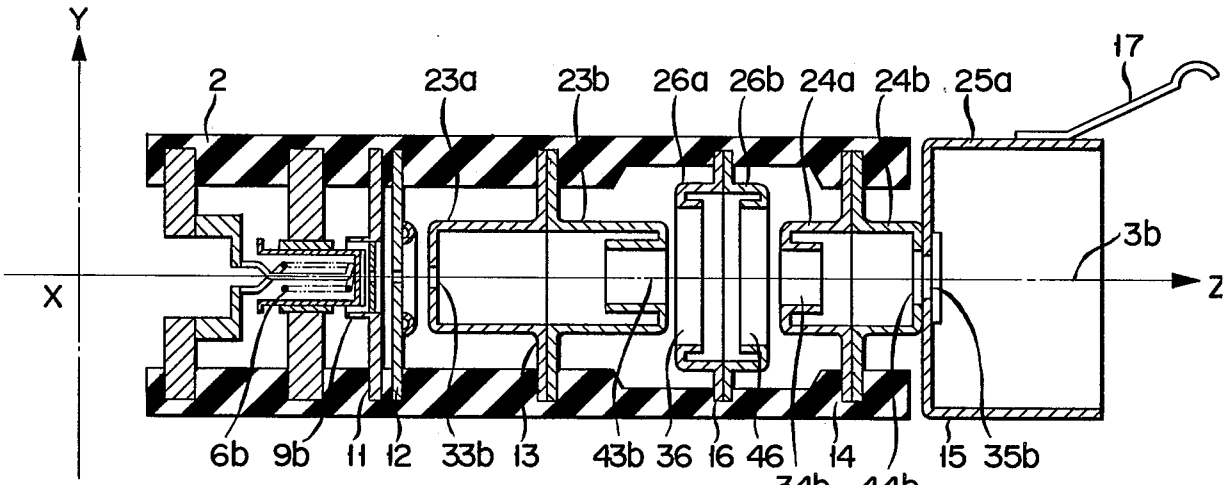
FIG. 2 is a schematic sectional view of the principal part of the electron gun of FIG. 1 taken along a plane perpendicular to a plane containing the tube axis and three electron beams.
Figure 3:
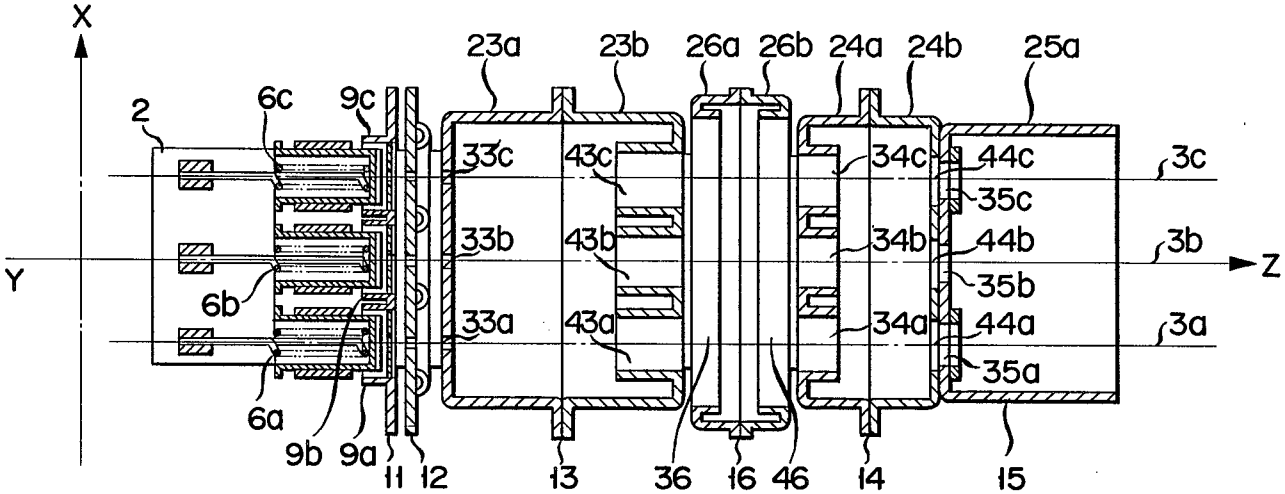
FIG. 3 is a schematic sectional view of the principal part of the electron gun of FIG. 1 taken along the plane containing the tube axis and the three electron beams.

An electron gun according to one embodiment of the present invention applied to a color picture tube will now be described in detail. Referring to FIGS. 1, 2 and 3, there is shown an in-line electron gun 1. In these drawings, direction X is a direction parallel to the in-line direction of the electron gun 1, direction Y is a direction perpendicular to both direction X and the tube axis, and direction Z is a direction in which the tube axis extends and which is perpendicular to both directions X and Y. FIG. 2 is a sectional view of the electron gun 1 taken along a plane containing directions Y and Z, and FIG. 3 is a sectional view of the electron gun 1 taken along a plane containing directions X and Z.

As shown in FIGS. 1, 2 and 3, the electron gun 1 comprises a plurality of electrodes and an insulating support means 2 for supporting the electrodes. The electrodes include cathodes *9a*, *9b* and *9c* arranged in line, first, second, third and fourth grids 11, 12, 13 and 14, a convergence electrode 15, and an auxiliary electrode 16 disposed between the third and fourth grids 13 and 14 and greater in size than the same. Three heaters *6a*, *6b* and *6c* for generating three electron beams *3a*, *3b* and *3c* are arranged in the cathodes *9a*, *9b* and *9c*, respectively. The three electron beams *3a*, *3b* and *3c* generated by the heaters *6a*, *6b* and *6c* in the cathodes *9a*, *9b* and *9c* are passed through the electrodes 11, 12, 13, 16, 14 and 15, respectively, and caused to hit against red, green and blue phosphor layers (not shown) of a fluorescent screen as a target. The grids 11 to 14 and the convergence electrode 15 have apertures for passing through the electron beams as mentioned later and are unitized.

The electron gun 1 is formed of two fundamental sections: a crossover spot forming section, hich includes a beam forming region, consisting of the cathodes 9 and the first and second grids 11 and 12, and an accelerating and focusing lens section for focusing the electron beams on the screen. The crossover spot forming section may also be referred to as a four-pole section, which consists of the cathodes 9 and the first, second, and third grids 11, 12 and 13. The accelerating and focusing lens section is normally referred to as a main lens section, which consists of the third and fourth grids 13 and 14. Thus, the third grid 13 is used in common in the four-pole section and the main lens section.

The construction of these electrodes will now be described in detail. The first and second grids 11 and 12 are planar in shape and arranged in close vicinity to each other. The third grid 13, which is located close to the second grid 12, is formed of two bathtub-shaped electrodes *23a* and *23b* which are joined together. The fourth grid 14, which is located at a predetermined distance from the third grid 13, is also formed of two bathtub-shaped electrodes 24a and 24b which are joined together. The convergence electrode 15 is formed of a single cup-shaped electrode 25a which is welded to the fourth grid 14. Three circular apertures are formed in each of the planar first and second grids 11 and 12 and the bottom face portions of both of the bathtub-shaped electrodes 23a, 23b, 24a and 24b of the third and fourth grids 13 and 14 and the cup-shaped electrode 25a of the convergence electrode 15. Each set of three apertures is aligned with its adjoining counterparts so as to be arranged along the paths of the individual electron beams.

The apertures of the first and second grids 11 and 12 are relatively narrow, and the apertures 33a, 33b and 33c of the third grid 13 on the side facing the second grid 12 are greater than those of the first and second grids 11 and 12. The apertures 43a, 43b and 43c of the third grid 13 on the side facing the fourth grid 14, which are relatively wide, are equal in diameter to the apertures 34a, 34b and 34c of the fourth grid 14 on the side facing the third grid 13. The apertures 35a, 35b and 35c of the convergence electrode 15 are narrower than the 43a, 43b and 43c of the third grid 13 and the apertures 34a, 34b and 34c of the fourth grid 14. Control members, which are known, for example, by Japanese Patent Disclosure No. 26208/1976, are provided near the apertures 44a and 44b of the convergence electrode 15. The auxiliary electrode 16 is formed of two bathtub-shaped electrodes 26a and 26b, and oval shaped apertures 36 and 46 are formed in the bottom faces of the bathtub-shaped electrodes 26a and 26b, respectively.

Figure 4:
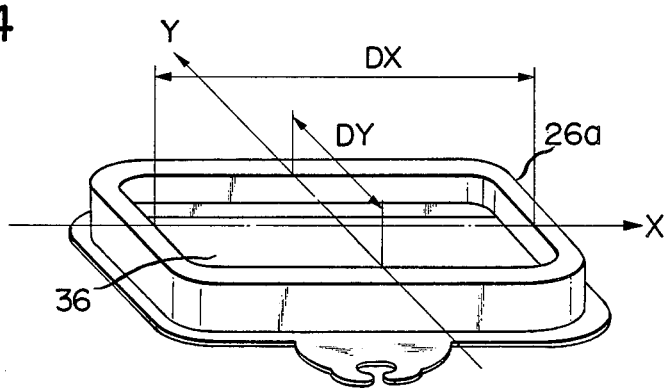
FIGS. 4 and 5 are perspective views showing components of an auxiliary electrode and a first grid, used in the embodiment of FIG. 1.
Figure 5:
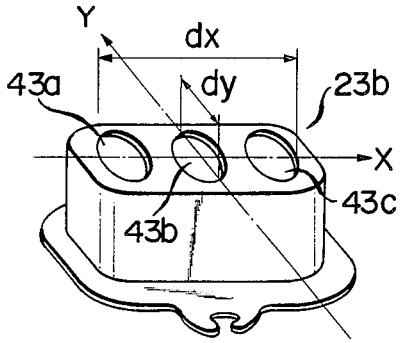

FIG. 4 shows a typical example of the bathtub-shaped electrode 26a of the auxiliary electrode 16, and FIG. 5 shows the bathtub-shaped electrode 23b of the third grid 13. As shown in FIGS. 4 and 5, the length DX of the aperture 36 of the auxiliary electrode 16 in direction X is greater than the distance dx covered by the apertures 43a, 43b and 43c of the third grid 13 arranged in a row in direction X. Also, the width DY of the aperture 36 in direction Y is greater than the Y-direction diameter dy of each of the apertures 43a, 43b and 43c. These relations may be expressed as follows:

$$DX > dx \text{ and } DY > dy. \quad (1)$$

As shown in FIG. 1, a bulb spacer 17 is attached to the outer periphery of the convergence electrode 15. The bulb spacer 17 is supplied with a voltage as high as about 25 kV which is applied to an anode terminal (not shown). The electron gun 1 constructed in this manner is sealed in a small cylindrical neck 18 which is formed of glass. A number of stem pins 19 are arranged on the left-hand end (FIG. 1) of the neck 18. The stem pins 19 support the electron gun 1 and voltages for the first to third grids 11, 12 and 13 and except for the fourth grid 14 and the convergence electrode 15, the voltage are externally applied through the stem pins 19.

By way of example, the electrodes arranged in the aforesaid manner are supplied with voltages as follows. A cut-off voltage of about 150 V is held on the cathodes 9, and a modulation signal is added to the cut-off voltage. The first grid 11 is grounded, while voltages of about 700 V and 6.5 kV are applied to the second and third grids 12 and 13, respectively. In addition, a high anode voltage of about 25 kV is applied to the fourth grid 14, and a voltage intermediate between those of the third and fourth grids 13 and 14 is applied to the auxiliary electrode 16.

Figure 6:
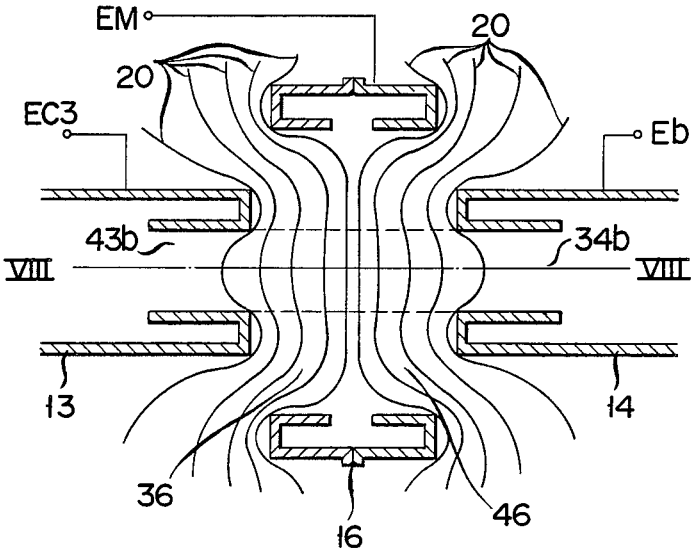
FIGS. 6 and 7 show an equipotential line distribution for illustrating an electrostatic electron lens of the invention.
Figure 7:
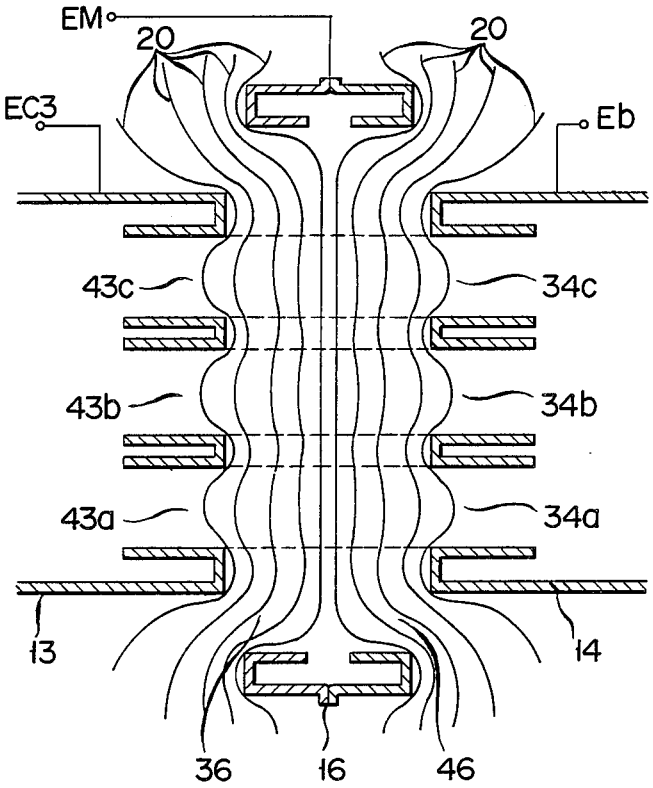

FIGS. 6 and 7 show an equipotential distribution of an electron lens in the main lens section with the electrode arrangement shown in FIGS. 2 and 3, respectively. In FIGS. 6 and 7, regions between the apertures 43a, 43b and 43c of the third grid 13 and the apertures 34a, 34b and 34c of the fourth grid 4, as indicated by broken lines, define the diameter of the electron lens. Numeral 20 designates equipotential lines. In the regions indicated by broken lines, the equipotential distribution is rarely disturbed. In these regions, moreover, the equipotential distribution is equivalent to that obtained when the separation distance between the third and fourth grids 13 and 14 is wide, and there is no influence of any ambient electrostatic fields.

Figure 8:
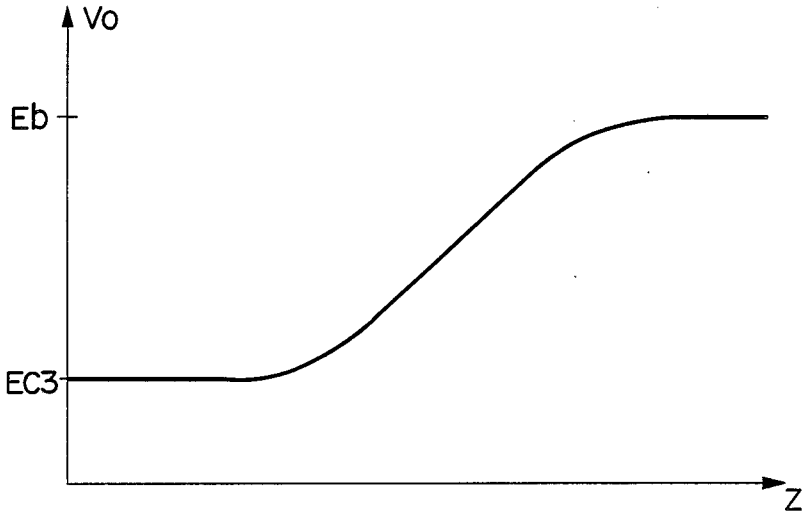
FIG. 8 shows a curve representing potential on the axis of the electron lens indicated by line VIII—VIII in FIG. 6.

FIG. 8 shows an axial potential distribution along line VIII—VIII of FIG. 6. The axial potential distribution varies considerably gradually in direction Z. The electrooptical magnification and the coefficient of spherical aberration of the electron lens are thus reduced so that the performance of the electron lens is greatly improved.

If the distance between two electrodes is merely increased, there will be actual influences of other electrostatic fields in the neck. In the electron lens according to the present invention, as shown in FIGS. 6 and 7, however, at least one auxiliary electrode 16 is disposed between the third and fourth grids 13 and 14. The auxiliary electrode 16 has an aperture diameter greater than the diameter of the electron lens, that is, the aperture diameter of the third and fourth grids 13 and 14. A voltage intermediate between those of the third and fourth grids 13 and 14 is applied to the auxiliary electrode 16. Accordingly, undesired electrostatic fields in the neck 18 are cut off, so that the essential electrostatic field for the electron lens will never be disturbed. The electron lens according to the present invention can obtain the same high performance as the type in which the distance between two electrodes is merely increased. In this case, the auxiliary electrode 16 requires only a single aperture, as compared with the three apertures for each of the other electrodes 11 to 15. Thus, the electron lens can improve its performance without changing the distances between the respective centers of the three apertures of the other electrodes 11 to 15.

In order to entirely remove the influence of the potential of the auxiliary electrode 16, in the above embodiment the sizes of the apertures 36 and 46 of the auxiliary electrode 16 must be increasingly wider than the sizes of the apertures 43a, 43b, 43c, 34a, 34b and 34c of the third and fourth grids 13 and 14 as the distance between the third and fourth grids 13 and 14 becomes greater. If the sizes of apertures 36 and 46 of the auxiliary electrode 16 is not great enough, the electric field of the electron lens between the third and fourth grids 13 and 14 is disturbed by the potential of the auxiliary electrode 16 so that the beam spot on the target is distorted. This distortion of the beam spot can be corrected by adjusting the potential, position, and aperture shape of the auxiliary electrode 16. For example, if the sizes of the apertures 36 and 46 of the auxiliary electrode 16 are not sufficiently large in both directions X and Y, two substantial quadrupole lenses are formed in the regions between the three circular apertures 43a, 43b and 43c of the third grid 13 and the one bathtub-shaped aperture 36 of the auxiliary electrode 16 and between the apertures 34a, 34b and 34c of the fourth grid 14 and the other bathtub-shaped aperture 46 of the auxiliary electrode 16. Since the directions in which the electron beams converge or diverge at these quadrupole lenses are opposite to each other, the direction of distortion of the beam spot varies with the voltage of the auxiliary electrode 16. If the voltage of the auxiliary electrode 16 is too low or too high, the shape of the beam spot is horizontally or vertically elongated, but if the voltage of the auxiliary electrode 16 is proper, the beam spot is circular. This proper voltage is a little lower than the voltage intermediate between the respective potential of the third and fourth grids 13 and 14. The reason is that lens forces acting on the electron beams are different due to the differences in speed and diameter between the electron beams in the quadrupole lenses, although the directions of the quadrupole lenses act in the opposite direction to the electron lens.

Since the circular beam spot is formed on the target, the distortion of the beam may be corrected by changing the shape of the aperture 36 or 46 of the auxiliary electrode 16. Also, the beam distortion may be corrected by adjusting the position of the auxiliary electrode 16, that is, the distances between the third grid 13 and the auxiliary electrode 16 and between the fourth grid 14 and the auxiliary electrode 16. Naturally, this correction may be performed in any other region than the region of the auxiliary electrode 16. For example, the electron beam may have astigmatism at the beam generating section so that the astigmatism is canceled in the region of the auxiliary electrode 16.

In a color picture tube, the electron gun 1 must converge the three electron beams on a common point on the target, i.e., a mask or screen. This may be achieved by several methods, including a method in which electron guns on either side are inclined relative to a central one, a method in which main lens sections or other electron lens sections on either side are inclined relative to a main lens section or other electron lens section in the center, and a method in which asymmetrical lenses are formed at main lens sections or other electron lens sections on either side. These methods may be directly applied to the present invention. According to the present invention, moreover, the three electron beams can also be converged on a common point on the target through the region of the auxiliary electrode 16.

Figure 9:
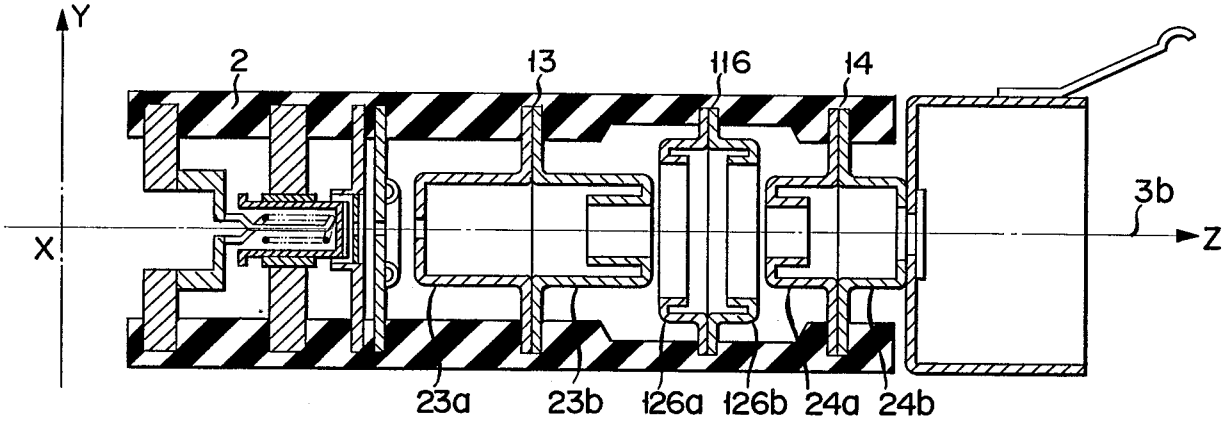
FIGS. 9 to 12 are schematic sectional views showing modified examples of the auxiliary electrode of the electron gun of FIG. 1, in which FIGS. 9 and 11 correspond to FIG. 2 and FIGS. 10 and 12 correspond to FIG. 3.
Figure 10:
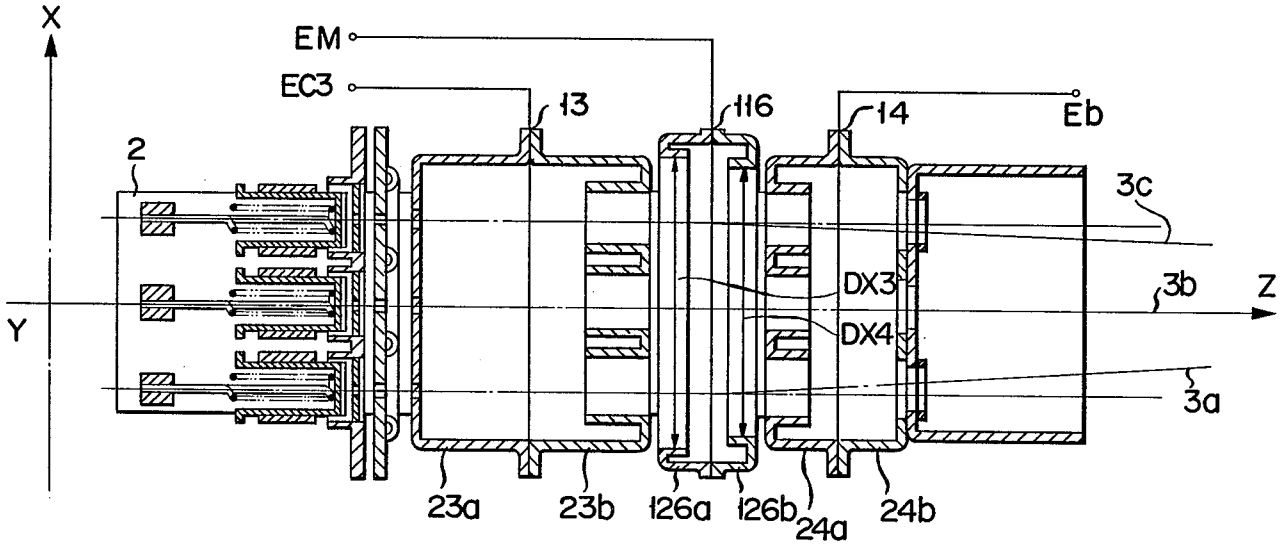

Referring now to FIGS. 9 and 10, a second embodiment of the auxiliary electrode will be described. In FIGS. 9 and 10, like reference numerals are used to designate like portions as included in the first embodiment shown in FIGS. 1 to 3. As shown in FIG. 10, the X-direction diameter DX4 of an auxiliary electrode **126*b* on the side of the fourth grid 14 is shorter than the X-direction diameter DX3 of an auxiliary electrode 126*a* on the side of the third grid 13. As a result, the electron beams 3*a* and 3*c* on either side are slightly deflected toward the central electron beam 3*b* so that the three electron beams 3*a*, 3*b* and 3*c* are converged on the target. The reason is that the potential of the auxiliary electrode 126*b* on the side of the fourth grid 14, on a cross section taken along plane X-Z, has a greater influence on the electron lens than the potential of the auxiliary electrode 126*a* on the side of the third grid 13 and that the former is lower than an average potential in the region so that the electron beams 3*a* and 3*c*** are subjected to an inward force.

Figure 11:
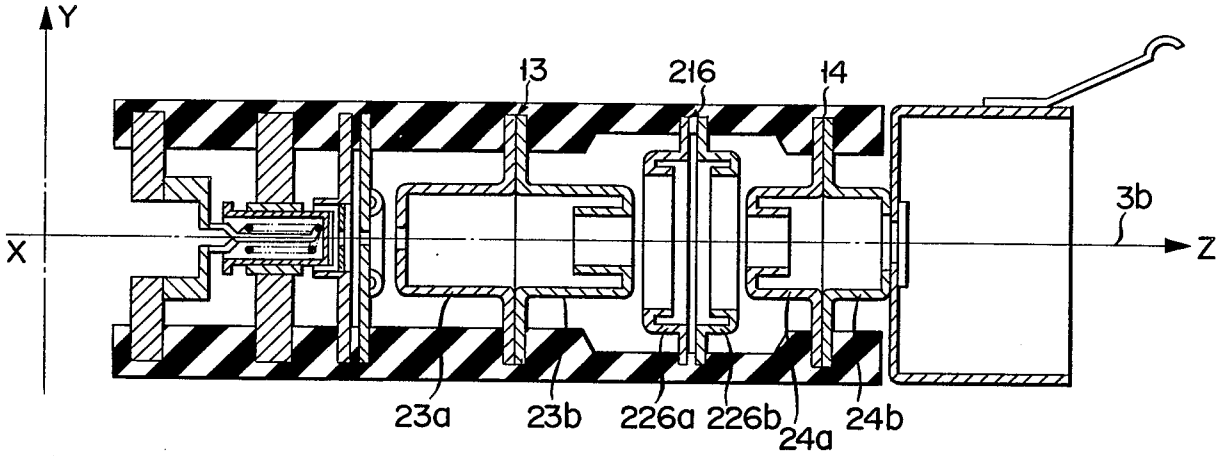
Figure 12:
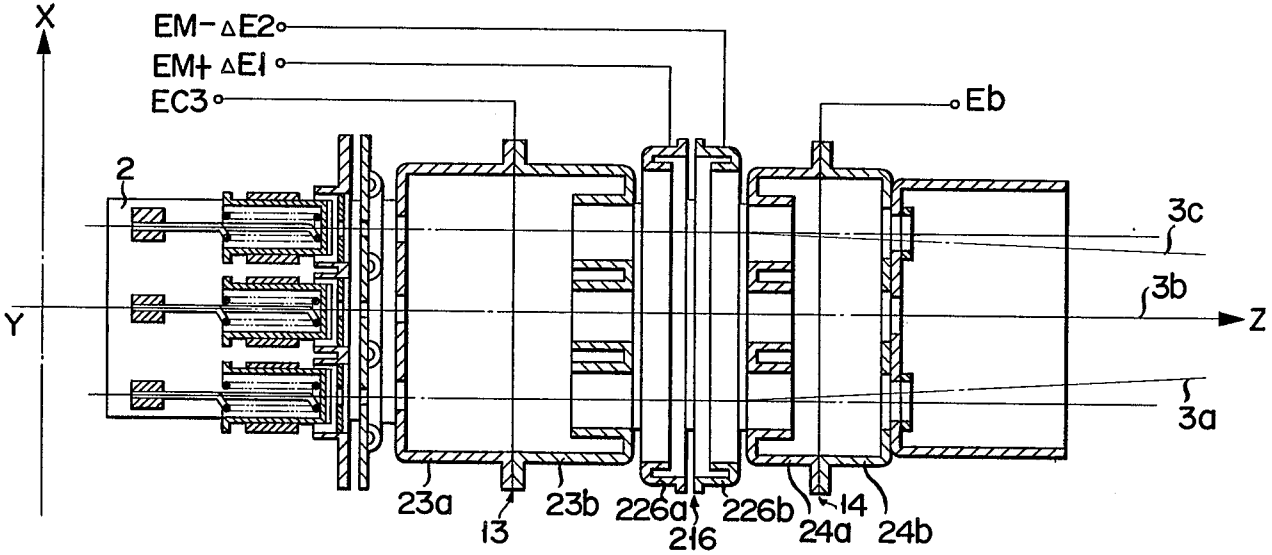

FIGS. 11 and 12 show a third embodiment different from the auxiliary electrode 116 shown in FIGS. 9 and 10. As shown in FIGS. 11 and 12, the electron gun 1 of this embodiment includes two separated auxiliary electrodes **226*a* and 226*b*. The potentials of the auxiliary electrodes 226*a* and 226*b* are intermediate between those of the third and fourth grids 13 and 14. The potential of the auxiliary electrode 226*b* on the side of the fourth grid 14 is a little lower than that of the auxiliary electrode 226*a* on the side of the third grid 13. Thus, as in the second embodiment, the three electron beams 3*a*, 3*b* and 3*c* are converged on the target. In this case, the convergence may be adjusted by suitably changing the length of the two auxiliary electrodes 226*a* and 226*b***.

Figure 13:
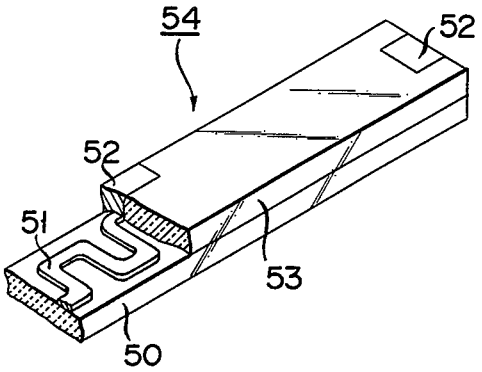
FIG. 13 is a cutaway perspective view showing a resistor used in the embodiment of FIG. 1.
Figure 15:
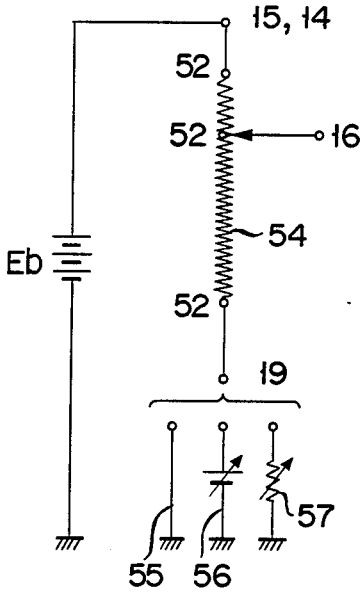
FIG. 15 is an electric circuit diagram related to the resistor shown in FIG. 14.
Figure 14:
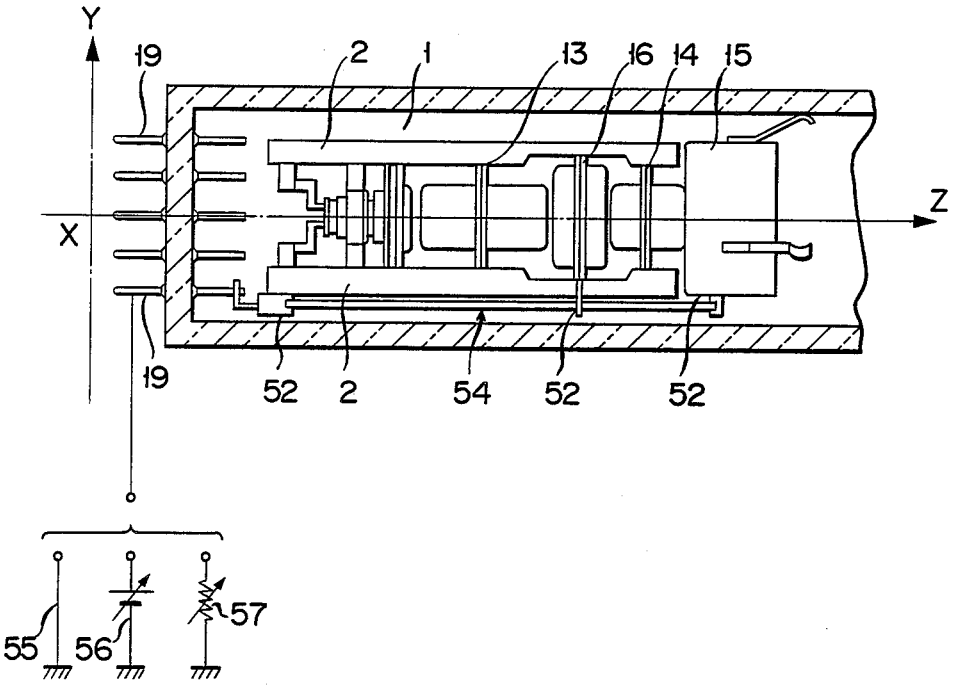
FIG. 14 is a schematic side view showing the electron gun according to the first embodiment incorporating the resistor of FIG. 13.

In the first to third embodiments described above, the voltages of the auxiliary electrodes 16, 116 and 226 are externally applied through the stem pins 19. According to the present invention, however, these voltages may be applied by dividing resistances. FIGS. 13, 14 and 15 show an example of a resistor 54 subjected to resistance division, embodied in the first embodiment. As shown in FIG. 13, the resistor 54 includes a thin substrate 50 formed of ceramics and a resistive material 51 and terminal portions 52 which are arranged on the substrate 50. Preferably, the resistive material 51 is mainly formed of an oxide compound based on palladium or ruthenium, especially a mixture of ruthenium oxide and glass. The substrate 50 and the resistive material 51 (except for the terminal portions 52) are coated with a thin insulating layer 53 of glass. As shown in FIG. 14, the resistor 54 is attached to the outside of the insulating support means 2 of the electron gun 1 with respect to direction Y. The terminal portion 52 at one end of the resistor element 54 is connected to the convergence electrode 15 or the fourth grid 14, and a high anode voltage is applied to the terminal portion 52. The terminal portion 52 at the other end of the resistive body 54 is connected to one of the stem pins 19, which is connected to a ground voltage 55, a low-voltage source 56, or another resistor 57 outside the electron gun 1. The terminal portion 52 in a suitable intermediate position between the two ends of the resistor 54 is connected to the auxiliary electrode 16. FIG. 15 is an electric circuit diagram showing the resistor 54. A high anode voltage Eb is divided by the resistor 54, and divided voltage is applied to the auxiliary electrode 16.

In the embodiment shown in FIG. 14, the resistor 54 is in the form of a plate. According to the present invention, however, the resistor 54 may be divided in two by the terminal portion 52 connected to the auxiliary electrode 16 or may be formed of a number of resistors. Alternatively, the resistor 54 may be formed by applying the resistive material 51 directly to the outer lateral face of the insulating support frame 2. Naturally, the insulating support means 2 may itself be used as the resistor 54.

Figure 16:
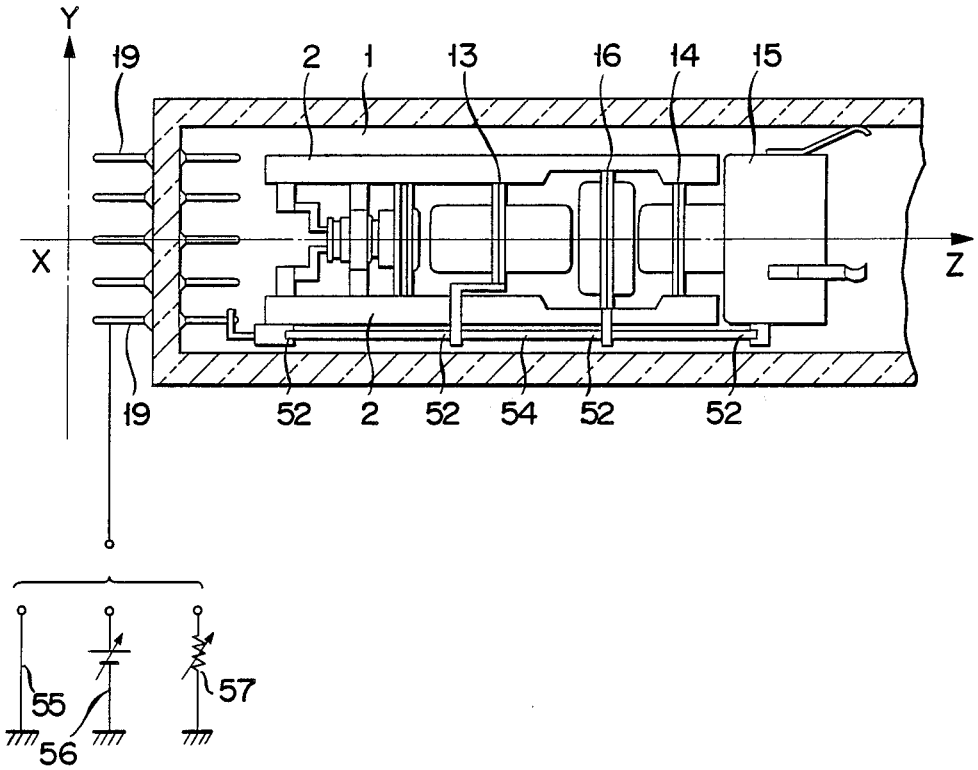
FIG. 16 is a schematic side view showing the electron gun according to the first embodiment incorporating the resistive body of FIG. 13, in which the resistor is connected in a modified manner.

In the embodiment shown in FIG. 14, moreover, the terminal portion 52 at one end of the resistor 54 is connected to one of the stem pins 19. Alternatively, however, this one-end terminal portion 52 may be connected to the third grid 13 or another grid. As shown in FIG. 16, furthermore, another terminal portion 52 may be provided between the terminal portion 52 at the one end and the terminal portion 52 connected to the auxiliary electrode 16 so that the fourth terminal portion 52 is connected to the third grid 13. Thus, the voltage divided by the resistive body 54 may be applied to the third grid 13.

As described above, part of the high anode voltage divided by the resistor 54 is applied to the auxiliary electrode 16. Accordingly, it is unnecessary to apply middle or high voltage to the auxiliary electrode 16 through the stem pins 19, so that the voltage-withstand property of the bottom part of the neck portion including the stem pins 19 is improved. Thus, the cathode-ray tube can be offered with high practicability. Also, voltage of the third grid 13 is applied by dividing the resistance of the resistor 54, so that the voltage-withstand property of the neck portion is improved. The convergence of the electron lens can be adjusted to some degree with ease, since the voltage of the third grid 13 can be controlled with a low voltage through the stem pins 19.

The high anode voltage is lowered substantially to the ground voltage level through the resistor 54 with high resistance, so that undesired spark current produced in the cathode-ray tube can greatly be reduced, and transistors, ICs and other devices arranged out of the cathode-ray tube can be protected against the spark current in the cathode-ray tube.

According to the present invention, moreover, the resistor 54 may be made considerably greater in size than a conventional one. In addition the resistor 54 can readily be attached to the electrode support means 2, and the manufacture of the electron gun 1 is thus very easy. Since the distance across the auxiliary electrode 16 is long, leakage current cannot easily flow through the auxiliary electrode 16. Therefore, it is easy to adjust the convergence force of the electron beams 3*a*, 3*b* and 3*c* in directions X and Y and the shape of these beams.

According to the present invention, the electron gun 1 does not always require a number of electrodes and a number of voltages to be applied thereto. Use of a single electrode and a single voltage therefor ensures the same effect of the electron lens as is obtained with use of a number of electrodes and voltages. In the electron gun 1 of the invention, moreover, the middle voltage to be applied to the auxiliary electrode 16 need not always be obtained by dividing the resistance of the resistor 54, and may also be obtained through one of the stem pins 19.

Figure 17:
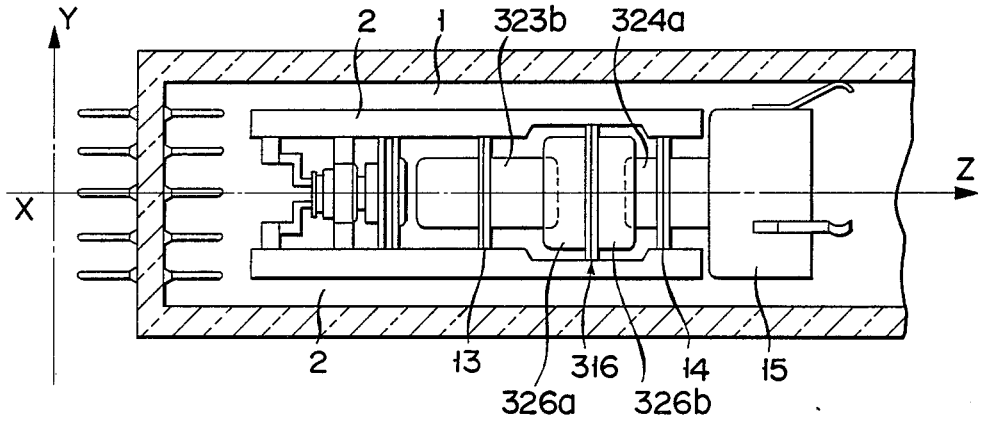
FIG. 17 is a schematic side view of an electron gun similar to the one shown in FIG. 1, showing a modified example of the arrangement of the auxiliary electrode of FIG. 1.

In the first to third embodiments described above, the auxiliary electrodes 16, 116 and 216 are disposed between the third and fourth grids 13 and 14 at predetermined distances therefrom. According to the present invention, however, each of the auxiliary electrodes 16, 116, 216 may partially cover one or both of the third and fourth grids 13 and 14. FIG. 17 shows an embodiment in which an auxiliary electrode 316 partially covers both the third and fourth grids 13 and 14. In this embodiment, the auxiliary electrode 316 and the third and fourth grids 13 and 14 overlap one another with gaps between them in the radial direction of the neck, so that the influences of undesired electrostatic fields generated from the inner wall of the neck are eliminated thoroughly. Thus, it is possible to completely prevent a change of convergence due to electric charges of the inner wall of the neck, which constitutes a drawback of a prior art color picture tube.

Figure 18:
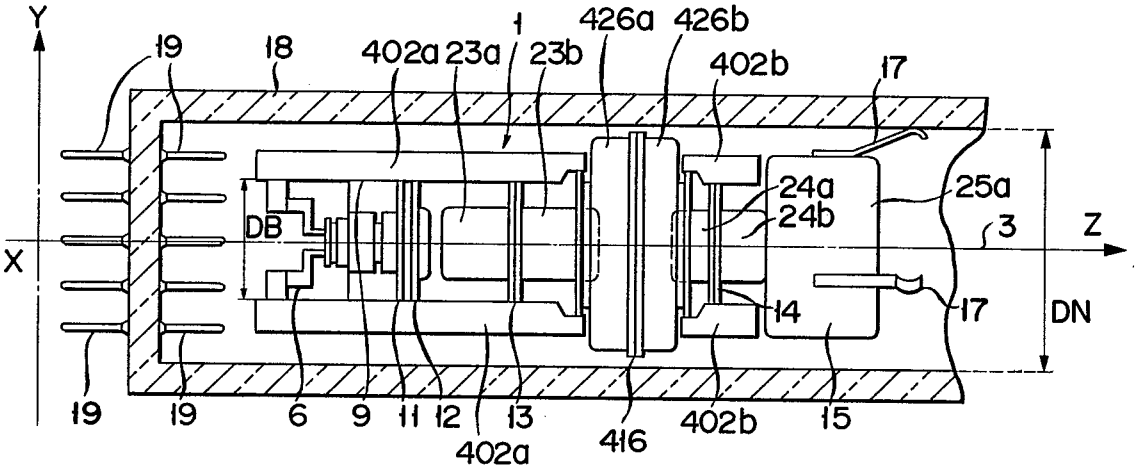
FIG. 18 is a schematic side view of an electron gun similar to FIG. 1, showing a modified example of the embodiment of FIG. 1.
Figure 19:
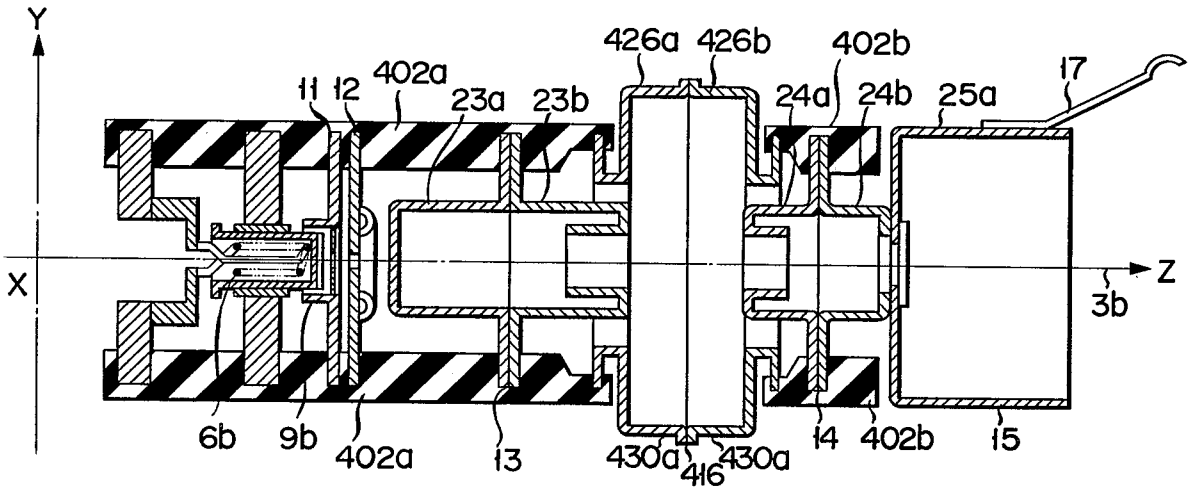
FIGS. 19 and 20 are schematic sectional views similar to FIGS. 2 and 3, respectively, showing the principal parts of the electron gun of FIG. 18.
Figure 20:
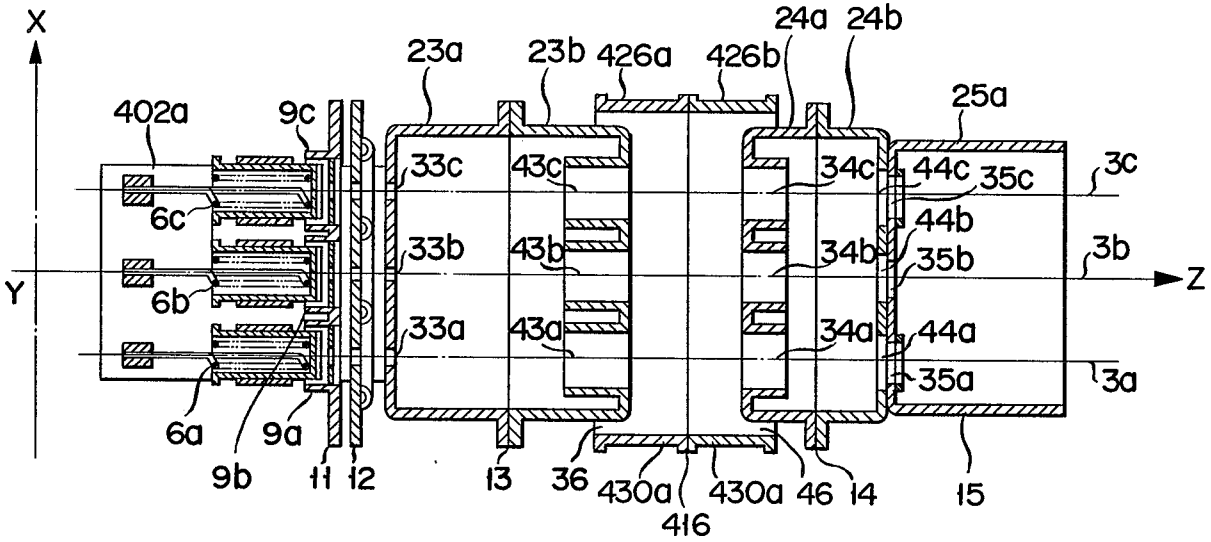

If an auxiliary electrode 416 partially covers both the third and fourth grids 13 and 14, as shown in FIGS. 18, 19 and 20, each of a pair of insulating support frames 402 may be divided into two subframes 402*a* and 402*b* so that the auxiliary electrode 416 is interposed between them. This division of the support frame 402 allows the auxiliary electrode 416 to be maximized in radial size within the inner wall of the neck. As a result, the separation distance of the third and fourth grids 13 and 14 can be increased. Thus, the electron lens can be improved in performance, and the distortion of the beam spot can be adjusted with ease.

Figure 21:
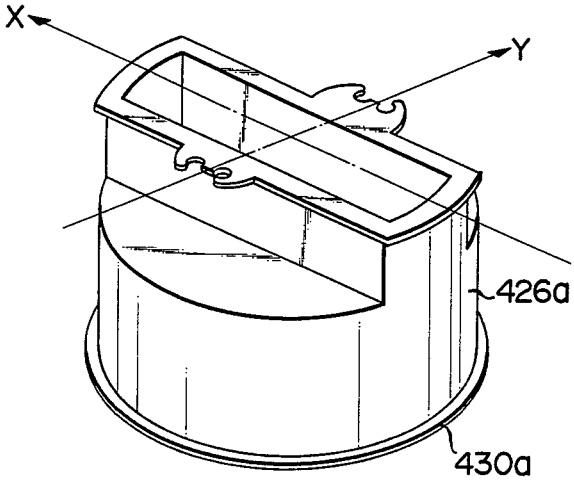
FIG. 21 is a perspective view of a component of the auxiliary electrode shown in FIG. 18.
Figure 22:
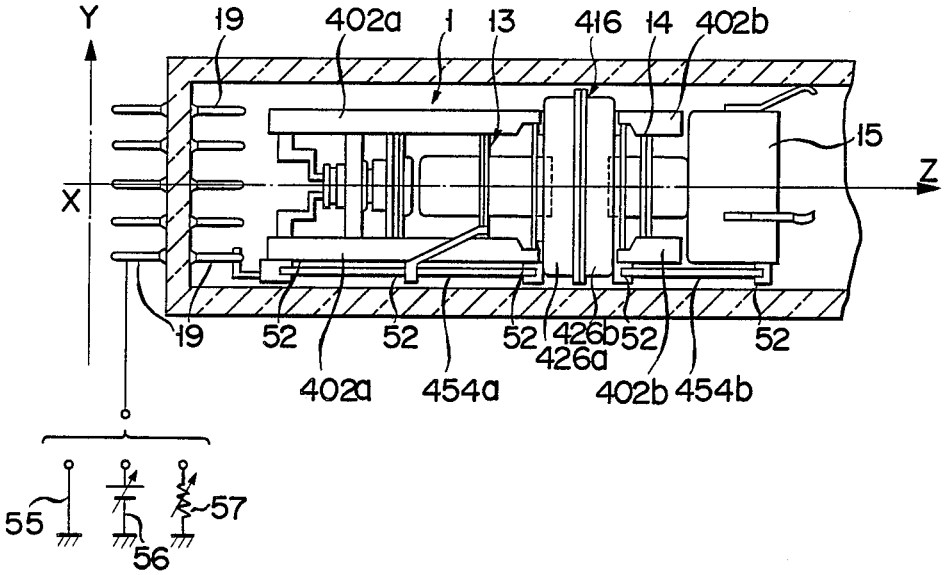
FIG. 22 is a schematic side view showing the electron gun according to the embodiment of FIG. 18 incorporating a resistor.

FIG. 21 shows one of a pair of components 426*a* and 426*b* of the auxiliary electrode 416 of the electron gun 1. FIG. 22 shows a modified example of the resistor in which two resistor elements 454*a* and 454*b* are arranged in the electron gun 1. The voltage of the auxiliary electrode 416 is obtained by dividing a high anode voltage by means of the resistor elements 454*a* and 454*b*.

Figure 23:
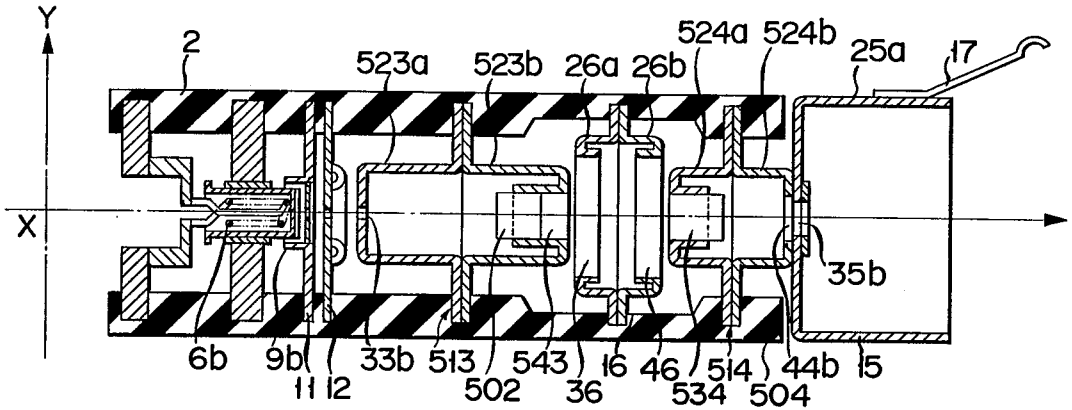
FIGS. 23 and 24 are schematic sectional views similar to FIGS. 2 and 3, respectively, showing the principal part of an electron gun as a modified example of the embodiment of FIG. 1.
Figure 24:
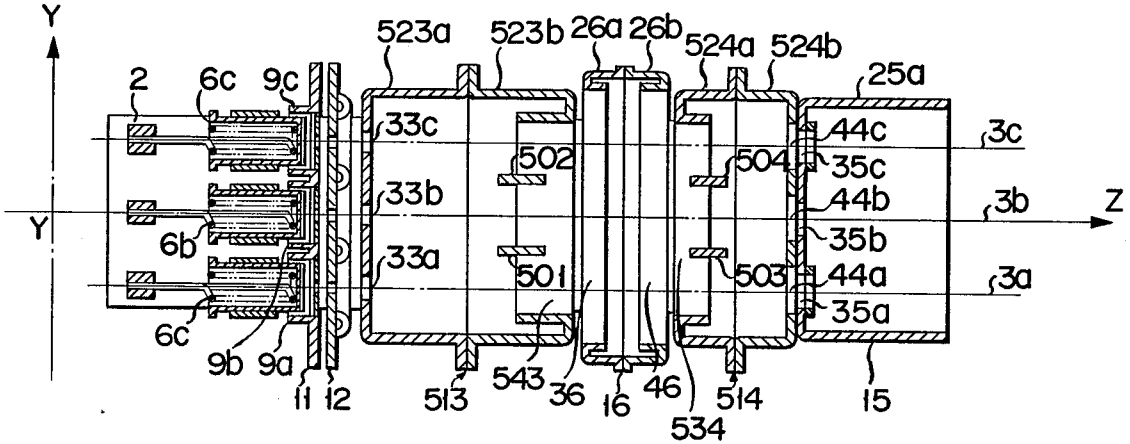
Figure 25:
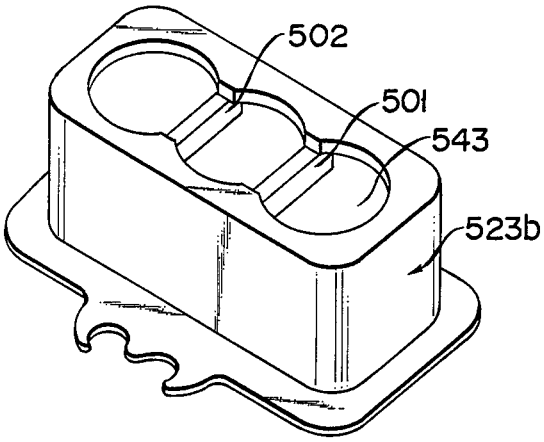
FIG. 25 is a perspective view of a component of a grid of a main lens section shown in FIGS. 22 and 23.

Referring now to FIGS. 23 to 27, there will be described various embodiments of the electron gun 1 of the present invention which also are applied to a color picture tube and improved for greater aperture of the electron lens. In the embodiment shown in FIGS. 23 to 25, third and fourth grids 513 and 514 are so designed that the aperture of the electron lens is greater on their front side. As shown in FIGS. 23 and 24, wide apertures 543 and 534 are formed in the bottom face portions of a bathtub-electrode 523*b* of the third grid 513 on the side facing the fourth grid 514 and a bathtub-shaped electrode 524*a* of the fourth grid 514 on the side facing the third grid 513, respectively. FIG. 25 shows the bathtub-shaped electrode 523*b* of the third grid 513 on the side facing the fourth grid 514. The apertures 543 and 534 are each defined by three circular apertures overlapping one another.

As shown in FIGS. 23 and 24, the bathtub-shaped electrode 523*b* is fitted with planar electrodes 501 and 502 in positions recessed from the bottom face portions of the electrode 523*b*. Likewise, the bathtub-shaped electrode 524*a* is fitted with planar electrodes 503 and 504. With this electrode arrangement, three electron lenses formed of the third and fourth grids 513 and 514 overlap one another. Thus, these electron lenses have a lens aperture which is wide in the optical sense. It is to be noted that in this embodiment, as in the first embodiment, the auxiliary electrode 16 formed of two bathtub-shaped electrodes is interposed between the third and fourth grids 513 and 514. With this arrangement, the electron lens has a long separation distance of the electrodes, as in the first to fifth embodiments, and has a distance optically greater than the lenses of the first to fifth embodiments. Therefore, it produces more distinguished effects.

Figure 26:
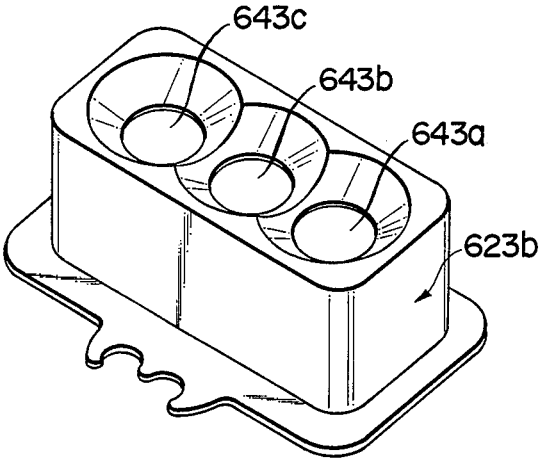
FIGS. 26 and 27 are perspective views of components different in shape from that of the grid of the main lens section shown in FIG. 25.
Figure 27:
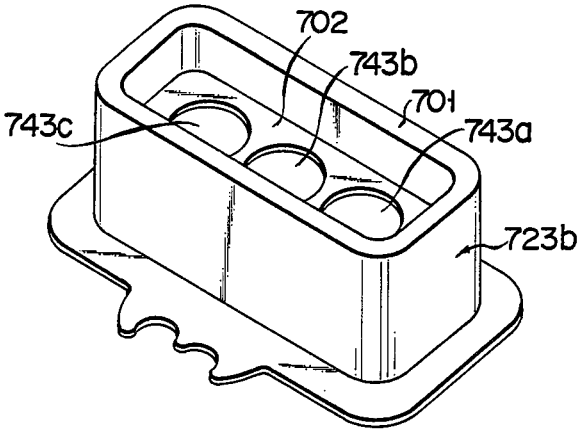

FIGS. 26 and 27 show modified examples of the bathtub-shaped electrode 523*b* of the third grid 513 on the side facing the fourth grid 514. A bathtub-shaped electrode 623*b* shown in FIG. 26 has three conical apertures 643*a*, 643*b* and 643*c* spreading with the advance of the electron beams. These apertures 643*a*, 643*b* and 643*c* overlap one another at the bottom. The bottom portion of a bathtub-shaped electrode 723*b* shown in FIG. 27 includes a peripheral rim 701 and a bottom face 702 recessed from the peripheral rim 701. Three apertures 743*a*, 743*b* and 743*c* are formed in the bottom face 702. Like the bathtub-shaped electrode 523*b* shown in FIG. 25, the bathtub-shaped electrode 623*b* and 723*b* shown in FIGS. 26 and 27 ensure a wide lens aperture for the electron lens of the main lens section. The configurations of the bathtub-shaped electrodes 623*b* and 723*b* shown in FIGS. 26 and 27 may suitably be applied to the bathtub-shaped electrode of the fourth grid 514 on the side facing the third grid 513.

Figure 28:
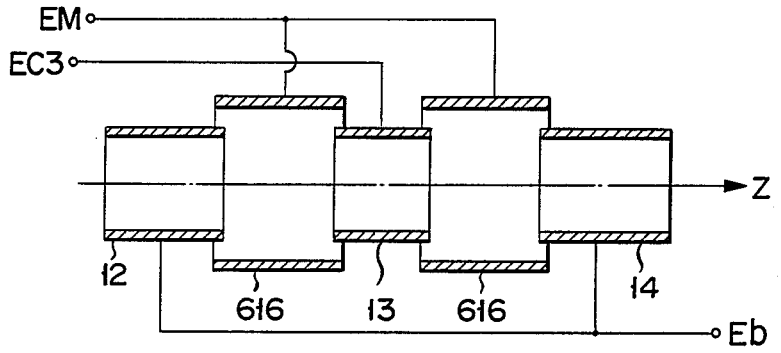
FIGS. 28, 29 and 30 are schematic sectional views showing arrangements of grids and an auxiliary electrode of the invention used in electron guns of alternative types.
Figure 29:
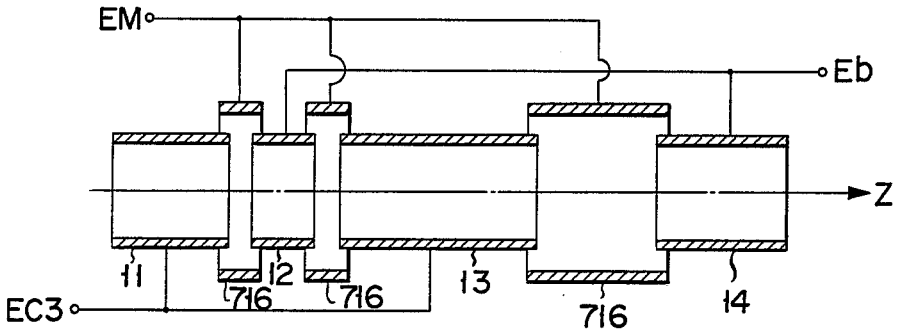
Figure 30:
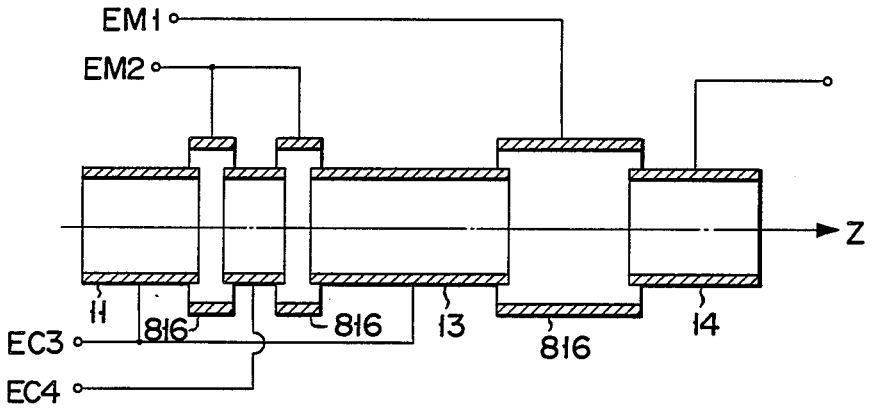

In all the embodiments described above, the construction of the electron lens is based on a bipotential lens which is formed of the third and fourth grids. The auxiliary electrode is disposed between the two grids, and has wide apertures. According to the present invention, however, the fundamental construction of the electron lens may be of a unipotential, quadripotential or periodic-potential type, as shown in FIGS. 28, 29 or 30. Alternatively, it may be of a tripotential type (not shown). As shown in FIGS. 28, 29 and 30, a number of auxiliary electrodes 616, 716 and 816 are arranged throughout the regions forming electron lenses of those various types. Naturally, the auxiliary electrodes 616, 716 and 816 may be arranged in only a main electron lens region without all the electron lens regions. In the constructions of the quadripotential and periodic-potential types shown in FIGS. 28 and 29, in particular, a voltage Ec3 of the third grid 13 may be set to about 8 to 9 kV, so that the electron beams scattered from the crossover spot forming region can be used in the best condition at the main lens section.

In the embodiments described above, moreover, three electron guns are arranged in line with one another. According to the present invention, however, three electron guns may be arranged in a delta, or a greater number of electron guns may be arranged in a suitable manner. Also, the present invention may be applied to a cathode-ray tube using a single electron gun.

What is claimed is:

1. An electron gun comprising:

means for emitting three electron beams;

main lens means for focusing the electron beams, the main lens means having electron beam paths through which said electron beams pass and including first and second electrodes arranged along the beam paths, said first and second electrodes each having three apertures through which the respective electron beams pass, said main lens means further including an auxiliary electrode located between the first and second electrodes and having an aperture through which each of the electron beams pass, the diameter of the aperture of the auxiliary electrode being greater than the respective sums of the diameters of the three apertures of the first and second electrodes; and voltage applying means for respectively applying first, second and auxiliary voltages to the first, second and auxiliary electrodes, the first, second and auxiliary voltages having different first, second and third voltage levels, respectively, thereby forming an electrostatic field between the first and second electrodes, wherein the third voltage level is higher than the first voltage level and lower than the second voltage level.

2. An electron gun according to claim 1, wherein said voltage applying means includes a resistor which is disposed beside the main lens means and which divides the second voltage to obtain the auxiliary voltage applied to the auxiliary electrode.

3. An electron gun according to claim 1, wherein the auxiliary electrode is divided into two electrode elements, the apertures of the two electrode elements varying in size at least in one direction perpendicular to the beam path.

4. An electron gun according to claim 1, wherein the auxiliary electrode is divided into two electrode elements, the auxiliary voltage applied to each of the two electrode elements having different voltage levels.

5. An electron gun according to claim 1, wherein the auxiliary electrode is divided into two electrode elements which are apart from each other by a predetermined distance.

6. An electron gun according to claim 1, wherein the auxiliary electrode covers a part of each of the first and second electrodes.

7. An electron gun according to claim 1, wherein said first and second electrodes further respectively include walls which face each other, the wall of each electrode having a depression in its central portion recessed away from the other electrode, the aperture of each of the first and second electrodes being formed in the depression.

8. An electron gun according to claim 1, wherein said first and second electrodes further respectively include peripheral walls which face each other, each peripheral wall having a conical depression tapered away from the electrode's peripheral wall so as to be recessed. at the central portion thereof, the aperture of each of the first and second electrodes being formed in the bottom portion of the depression.

9. An electron gun according to claim 1, further comprising an insulating support means for supporting the first and second electrodes and the auxiliary electrode, the insulating support means consisting of a plurality of support members arranged parallel to each other along the beam path and continuously extending to cover the beam forming means and the main lens means.

10. An electron gun according to claim 1, further comprising an insulating support means for supporting the first and second electrodes and the auxiliary electrode, the insulating support means consisting of a plurality of support members arranged parallel to each other along the beam path, each support member being divided into two parts spaced to permit interposition of the peripheral edge portion of the auxiliary electrode.

11. An electron gun according to claim 10, wherein the auxiliary electrode covers a part of each of the first and second electrodes.

* * * * *